United States Patent [19]

McGraw

[11] Patent Number: 5,076,463

[45] Date of Patent: Dec. 31, 1991

[54] THERMALLY STABILIZED HOT BEVERAGE SERVING VESSEL

[76] Inventor: Kenneth E. McGraw, 3983 Robin Hill Rd., LaCanada, Calif. 91011

[21] Appl. No.: 535,303

[22] Filed: Jun. 8, 1990

Related U.S. Application Data

[63] Continuation of Ser. No. 322,182, Mar. 13, 1989, abandoned.

[51] Int. Cl.[5] ..... F28D 1/06

[52] U.S. Cl. ..... 220/415; 220/676; 220/603; 126/400

[58] Field of Search ..... 220/428, 626, 603; 126/415, 400; 215/13.1; 62/457

[56] References Cited

U.S. PATENT DOCUMENTS

| | | | |
|---|---|---|---|
| D. 194,053 | 11/1962 | Cornelius | 220/ |
| 2,876,634 | 3/1959 | Zimmerman et al. | 215/13.1 X |
| 3,463,140 | 8/1969 | Rollor, Jr. | 126/400 X |
| 3,603,106 | 9/1971 | Ryan et al. | 220/428 X |
| 3,684,123 | 8/1972 | Bridges | 220/ |
| 3,766,975 | 10/1973 | Todd | 126/400 X |
| 4,768,354 | 9/1988 | Barnwell | 220/428 |

*Primary Examiner*—Steven M. Pollard

*Attorney, Agent, or Firm*—Stetina and Brunda

[57] ABSTRACT

A thermally stabilized vessel for the serving of hot liquid foods that causes the liquid food's initial temperature be rapidly reduced to a temperature which is comfortable for consumption and maintains the temperature of the hot liquid food at an elevated level, which is comfortable for consumption, for an extended period of time.

5 Claims, 1 Drawing Sheet

THERMALLY STABILIZED HOT BEVERAGE SERVING VESSEL

This is a continuation of copending application Ser. No. 07/322,182 filed on Mar. 13, 1989 now abandoned.

BACKGROUND

1. Field of Invention

This invention relates to beverage serving vessels , especially to beverage cups and bowls designed to maintain the temperature of the beverage at an elevated level for an extended period of time.

2. Description of Related Devices

Many, if not most, consumers of hot beverages prefer the temperature of their beverage to remain at an elevated level throughout the period of consumption without the temperature being too hot at the beginning of this period.

Heretofore a wide variety of vessels have been proposed and implemented for the purpose of consuming hot beverages.

One such type consists of a cup, or bowl, being manufactured of a ceramic or glass material. Users of this type of vessel find them to be marginally satisfactory in that they allow the temperature of the beverage to drop too quickly to a level that is too cool for comfortable consumption.

Another type of cup, or bowl, is manufactured of two layers of plastic in a manner which provides an insulation barrier to prevent the loss of the beverage's heat. This type of vessel does maintain the beverage at an elevated temperature for an extended period of time, however the initial temperature of the beverage remains at a level which is too high for comfortable consumption for an undesirably long period of time.

Most users, therefore, would find it desirable to have a cup, or bowl, which maintains the temperature of the beverage at an elevated level for an extended period of time while providing an initial beverage temperature that is comfortable for consumption.

OBJECTS AND ADVANTAGES

Accordingly I claim the following as the objects and advantages of the invention: to provide a vessel for consumption of beverages which rapidly reduces the temperature of a hot beverage from the initial level which is too high for comfortable consumption while maintaining the beverages temperature at a desirable level above room temperature for an extended period of time.

Readers will find further objects and advantages of the invention from a consideration of the ensuing description and the accompanying drawings.

DRAWING FIGURES

DRAWING REFERENCE NUMERALS

20—top of temperature stabilizer

30—cross section of temperature stabilizer

32—inner lining of insulated vessel

34—outer layer of insulated vessel

36—insulating zone

SINGLE-PIECE VESSEL

Description

Figure 1:
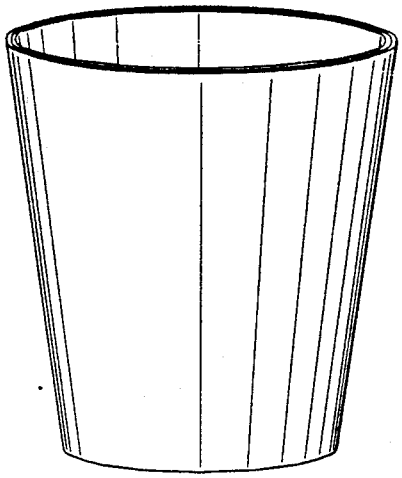
FIG. 1 shows a perspective view of a vessel according to the invention.
Figure 2:
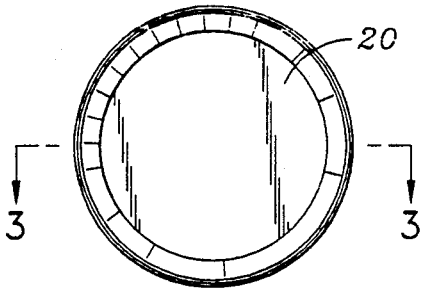
FIG. 2 shows a top view of such vessel
Figure 4:
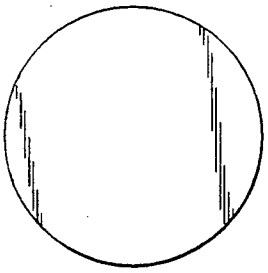
FIG. 4 shows a top view of such temperature stabilizer.
Figure 3:
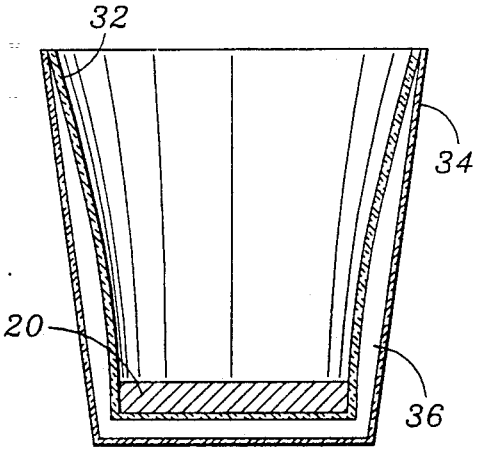
FIG. 3 shows a sectional view of such vessel along the line 3—3 of FIG. 2.
Figure 5:
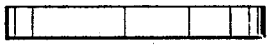
FIG. 5 shows a side view of such temperature stabilizer.

FIG. 1 shows a single-piece vessel, preferably a cup, according to the preferred embodiment of the invention. The vessel comprises an outer layer 34 which is preferably made of plastic which is molded to the desired external shape of the vessel. Inner lining 32 comprises the interior of the vessel for containing the beverage, preferably made of plastic with the bottom portion molded to temperature stabilizer 20 and the upper portion molded to the desired internal shape of the vessel. Between the outer layer 34 of the insulated vessel and the inner lining 32 of the insulated vessel is the insulating zone 36 containing an insulating medium, preferably dead air, to reduce heat loss through the walls of the vessel.

Temperature stabilizer 20 consists of a material mass, preferably aluminum, molded to a shape that permits the inner lining 32 to be molded around it, securing the temperature stabilizer 20 as an integral part of the inner lining 32.

SINGLE-PIECE VESSEL

Operation

The single-piece vessel (such as a cup) of FIG. 1 will perform a variety of functions including, stabilizing the temperature of hot beverages, decoration, containing hot or cold beverages, etc., but users will find it most useful for stabilizing the temperature of hot beverages. For this function, users should employ the thermally stabilized vessel as they would any other beverage serving vessel.

To stabilize the temperature of a hot beverage, such as coffee, the user should pour the hot beverage into the thermally stabilized vessel shown in FIG. 1 while the thermally stabilized vessel is at room temperature.

The hot beverage, normally at a temperature that is too high for comfortable consumption, coming into contact with the temperature stabilizer 20 will cause will cause heat to flow from the hot beverage to the temperature stabilizer 20. The heat flow will continue until the temperature of the hot beverage and the temperature stabilizer are stabilized at the same level.

Heat flow from the hot beverage to the temperature stabilizer will cause the temperature of the temperature stabilizer 20 to increase while the temperature of the hot beverage decreases to a level which is more comfortable for consumption. This will thus achieve the desired results of providing the user with a hot beverage which is at a temperature comfortable for consuming in a shorter period of time.

When the temperature of the hot beverage and the temperature stabilizer 20 have stabilized at a level which is more comfortable for consumption, further heat loss is inhibited by the insulating zone 36 contained between the inner lining of insulated vessel 32 and the outer layer of insulated vessel 34. Inhibition of the further loss of heat will cause the stabilized temperature of the hot beverage and the temperature stabilizer to remain at a comfortable level for an extended period of time.

The greatest amount of heat is lost at the top of the beverage where there is no insulation to reduce the heat flow. As the heat flows out the top, the temperature of the beverage decreases and causes a temperature imbalance between the beverage and the thermal stabilizer 20. This temperature imbalance will cause heat to flow from the temperature stabilizer 20 to the beverage and help maintain the temperature of the beverage at a desired elevated level. When a portion of the beverage has been consumed, the amount of beverage to be maintained at a desired elevated temperature is decreased and the ability of the temperature stabilizer 20 to maintain the beverage at a desired elevated temperature is improved. This transfer of heat from the from the temperature stabilizer 20 to the beverage contributes to the goal of maintaining the temperature of the beverage in the comfortable temperature range for the period of time that it is being consumed.

While the above description contains many specifications, the reader should not construe these as limitations on the scope of the invention, but merely as exemplifications of preferred embodiments thereof. Those skilled in the art will envision many other possible variations within its scope. For example skilled artisans will readily be able to change the dimensions and shape of the various embodiments. They will also be able to make the thermally stabilized vessel of alternative materials such as ceramic and plastic foam. They can utilize various methods of affixing the temperature stabilizer 20 to the inner lining of insulated vessel 32. They can change the relative locations of the temperature stabilizer 20 with respect to the other embodiments. They can form the thermally stabilized vessel by extrusion or machining. They can select other materials from which to manufacture the temperature stabilizer 20. Accordingly the reader is requested to determine the scope of the invention by the appended claims and their legal equivalents, and not by the examples which have been given.

I claim:

1. A temperature stabilizing vessel for receiving and substantially maintaining fluids at pre-existing temperatures, said vessel comprising:

an outer liner;

an inner liner having a closed bottom, said inner liner being sized and configured to be receivable into said outer liner in a manner wherein said inner liner and said outer liner define a space therebetween for insulating said inner liner from said outer liner; and a thermally conductive monostate heat transfer member disposed on said closed bottom of said inner liner so as to be in direct contact with the fluid within the vessel and covered by the fluid for all fluid levels within the vessel, so as to alleviate heat transfer from said transfer member directly to the open air, the entire mass of said monostate heat transfer member being operative to substantially conform to the fluid temperature to serve as a heat sink and facilitate maintenance of the fluid temperature within the vessel.

2. The vessel as defined in claim 1 wherein said heat transfer member has substantially uniform heat transfer characteristics between water freezing and water boiling temperatures.

3. The vessel as defined in claim 1 wherein said monostate heat transfer member has substantially uniform heat transfer characteristics between temperatures substantially above room temperature and temperatures substantially below room temperature.

4. The vessel as defined in claim 1 wherein said monostate heat transfer member comprises a mass of aluminum.

5. The vessel as defined in claim 1 wherein a quantity of insulating material is disposed within said space defined between said inner liner and said outer liner.

* * * * *